US005445227A

United States Patent [19]

Heppner

[11] Patent Number: 5,445,227

[45] Date of Patent: Aug. 29, 1995

[54] RELEASE MECHANISM FOR A HYDRAULIC POST DRIVER

[76] Inventor: Alden Heppner, Box 348, Lac la Biche, Alberta, Canada, T0A 2C0

[21] Appl. No.: 220,538

[22] Filed: Mar. 31, 1994

[51] Int. Cl.[6] ..... E02D 7/08

[52] U.S. Cl. ..... 173/124; 173/84; 173/89; 173/202

[58] Field of Search ..... 173/53, 54, 202, 203, 173/121, 122, 124, 89, 84, 204

[56] References Cited

U.S. PATENT DOCUMENTS

| | | | |
|---|---|---|---|
| 1,569,183 | 1/1926 | Herman et al. | 173/124 |
| 2,787,123 | 4/1957 | Delvaux | 173/124 |
| 2,792,689 | 5/1957 | Phares | 61/74 |
| 2,940,267 | 6/1960 | Shaver | 61/73 |
| 3,039,546 | 6/1962 | Janson et al. | 173/124 |
| 3,166,351 | 1/1965 | Baudrillard | 173/203 |
| 3,358,779 | 12/1967 | Cunningham | 173/119 |
| 3,490,548 | 1/1970 | Lake | 173/43 |
| 3,743,030 | 7/1973 | Gifford | 173/124 |
| 3,937,286 | 2/1976 | Wagner | 173/203 |
| 4,002,210 | 1/1977 | White | 173/26 |
| 4,064,964 | 12/1977 | Norden | 173/202 |
| 4,915,180 | 4/1990 | Schisler | 173/22 |
| 4,993,500 | 2/1991 | Greene et al. | 173/124 |
| 5,248,001 | 9/1993 | Moseley | 173/1 |

*Primary Examiner*—Scott A. Smith
*Attorney, Agent, or Firm*—Anthony R. Lambert

[57] ABSTRACT

A release mechanism for a hydraulic/pneumatic post driver is described. The post driver has a hammer and a guide for directing the hammer from a raised release position along a substantially vertical downward impact path. A hydraulically or pneumatically actuated fluid expandable cylinder is disposed above the hammer and has a telescopically extendible piston for lifting the hammer to the raised release position. The improvement includes one of the piston and the hammer having a female member with inwardly directed gripping dogs. The other of the piston and the hammer has a male member with outwardly directed gripping rollers. One of the inwardly directed gripping dogs and the outwardly directed gripping rollers is spring biased to maintain engagement between the dogs and rollers. A triggering mechanism is provided on the guide to overcome the biasing force of the spring to disengage the dogs and the rollers when the hammer reaches the raised release position.

6 Claims, 4 Drawing Sheets

RELEASE MECHANISM FOR A HYDRAULIC POST DRIVER

The present invention relates to a release mechanism for hydraulic/pneumatic post driver.

BACKGROUND OF THE INVENTION

Although there are many different configurations of post drivers, they all have in common the presence of a hammer, and some form of guide means for directing the hammer from a raised position along a substantially vertical downward path to impact upon a post. Some means must be provided for lifting the hammer to the raised position and then releasing the hammer to begin its downward path. Sometimes the hammer falls by force of gravity alone and sometimes the fall of the hammer is accelerated by means of springs.

Hydraulic and pneumatic post drivers use fluid expandable cylinders to lift the hammer of the post driver to the raised position. Hydraulic post drivers are described and illustrated in U.S. Pat. No. 2,940,267 and U.S. Pat. No. 4,915,180. A limiting factor for these post drivers is their ability to release the hammers. As long as the hydraulic or pneumatic fluid lines remain attached to the hammer, they unavoidably have the effect of dampening the potential impact; for it is the fall of the hammer that vacate the fluid lines.

SUMMARY OF THE INVENTION

What is required is an improved hammer release mechanism for a hydraulic/pneumatic post driver.

According to the present invention there is provided a release mechanism for a hydraulic/pneumatic post driver. The post driver has a hammer and guide means for directing the hammer from a raised release position along a substantially vertical downward impact path. A hydraulically or pneumatically actuated fluid expandable cylinder is disposed above the hammer and has a telescopically extendible piston serving as means for lifting the hammer to the raised release position. The improvement includes one of the piston and the hammer having a female member with inwardly directed gripping means. The other of the piston and the hammer has a male member with outwardly directed gripping means. One of the inwardly directed gripping means and the outwardly directed gripping means is spring biased to maintain engagement between the respective gripping means. Triggering means is provided on the guide means to overcome the biasing force of the spring to disengage the inwardly directed gripping means and the outwardly directed gripping means when the hammer reaches the raised release position.

With the release mechanism, as described above, the piston of the hydraulically or pneumatically actuated fluid expandable cylinder reaches down and engages the hammer to lift it to the raised release position. Once at the raised release position, the hammer is dropped and falls by force of gravity. At the point of release the fluid expandable cylinder is completely detached from the hammer. A preferred configuration will hereinafter be illustrated and further described. Beneficial results have been obtained when the hammer has a female top member with inwardly directed gripping dogs. Beneficial results have been obtained when the piston has a generally "V" shaped male member with outwardly biased engaging rollers at each extremity. A compatible triggering means includes inclined planes on the guide means and tripping rollers adjacent the gripping rollers at the extremities of the outwardly biased arms of the "V" shaped male member. The tripping rollers are vertically aligned with the guide means. The tripping rollers move along the guide means until they engage the inclined planes. As the tripping rollers move up the inclined planes, the biased arms of the "V" shaped male members move together thereby releasing the gripping rollers from the female member on the hammer to let the hammer fall by force of gravity.

Although beneficial results can be obtained through the use of the release mechanism, as described above, the impact of the hammer can be increased through the use of preload springs. Even more beneficial results may, therefore, be obtained when cylinders are mounted to the guide means. The cylinders contain springs with depending engagement members. The hammer has external pockets that receive the engagement members as the hammer is raised by the fluid expandable cylinder to the raised release position. As the hammer is raised the springs are compressed. The springs impart a violent downward acceleration to the hammer upon the hammer being released.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
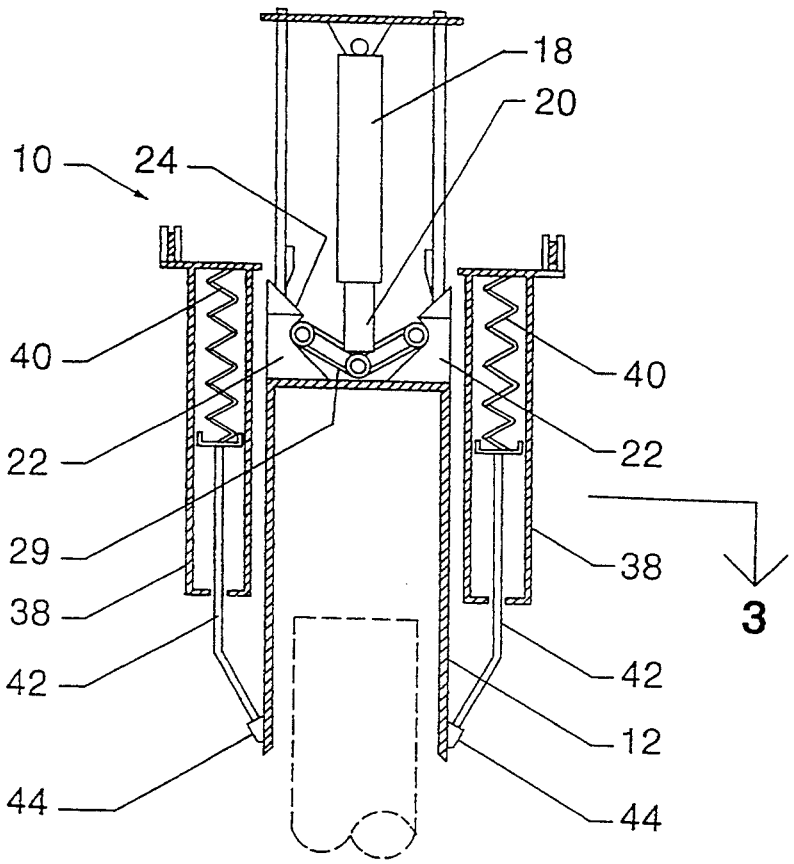
FIG. 1 is a side elevation view in longitudinal section of a release mechanism for a hydraulic/pneumatic post driver constructed in accordance with the teachings of the present invention, with hammer engaged.

The preferred embodiment, a release mechanism for a hydraulic/pneumatic post driver generally identified by reference numeral 10, will now be described with reference to FIGS. 1 through 5.

Figure 2:
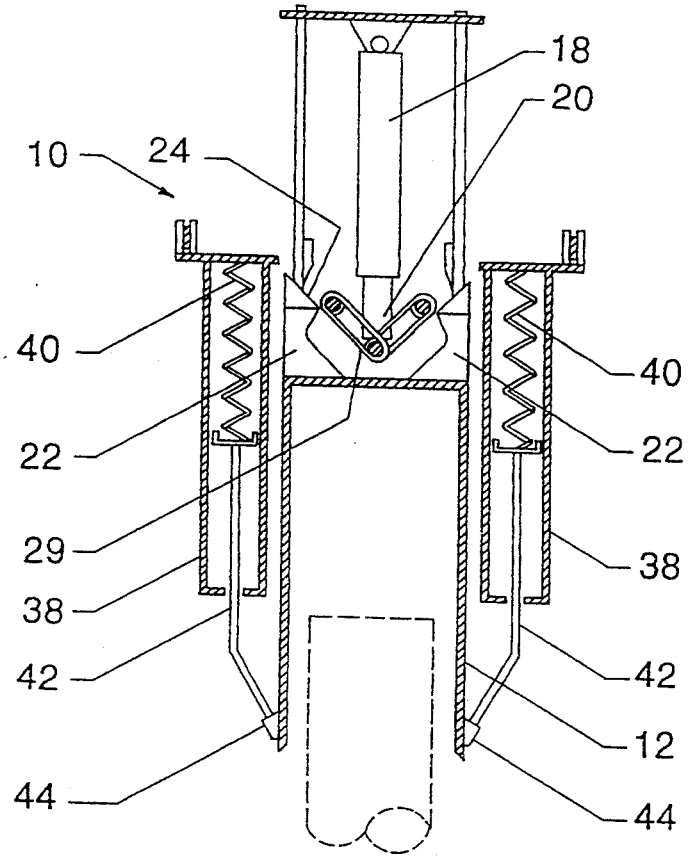
FIG. 2 is a side elevation view in longitudinal section of the release mechanism for a hydraulic/pneumatic post driver illustrated in FIG. 1, with hammer released.
Figure 3:
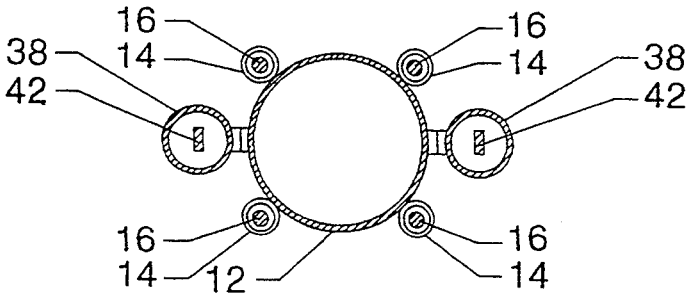
FIG. 3 is a top plan view in section taken along section line 3 of FIG. 1.
Figure 4:
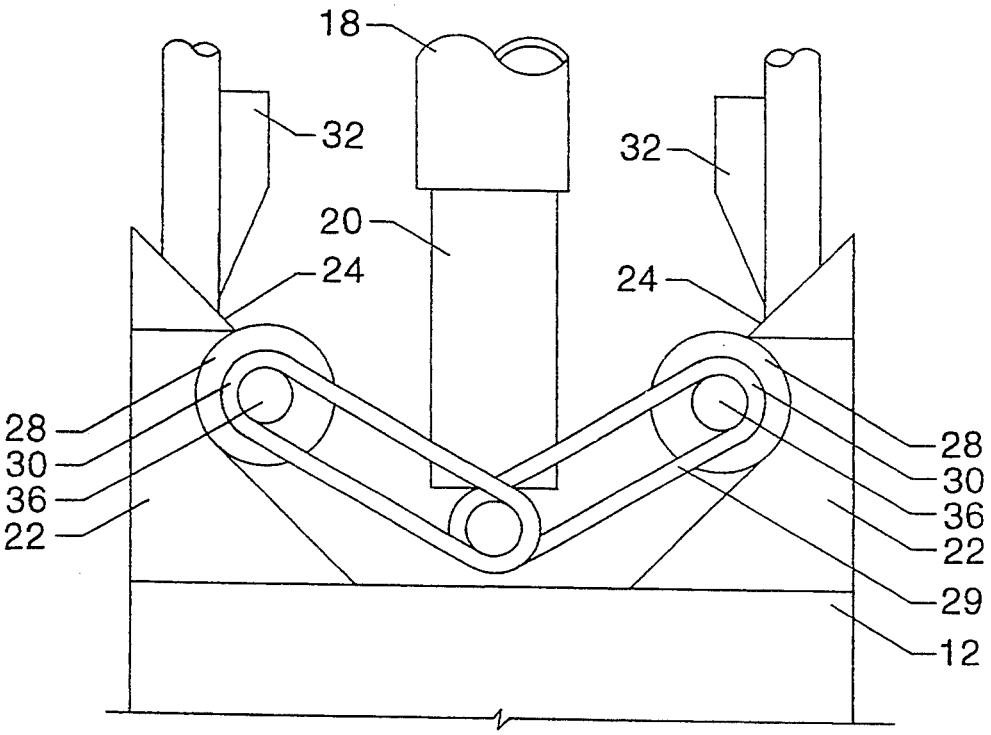
FIG. 4 is a detailed side elevation view in longitudinal section of a portion of the release mechanism illustrated in FIG. 1.
Figure 5:
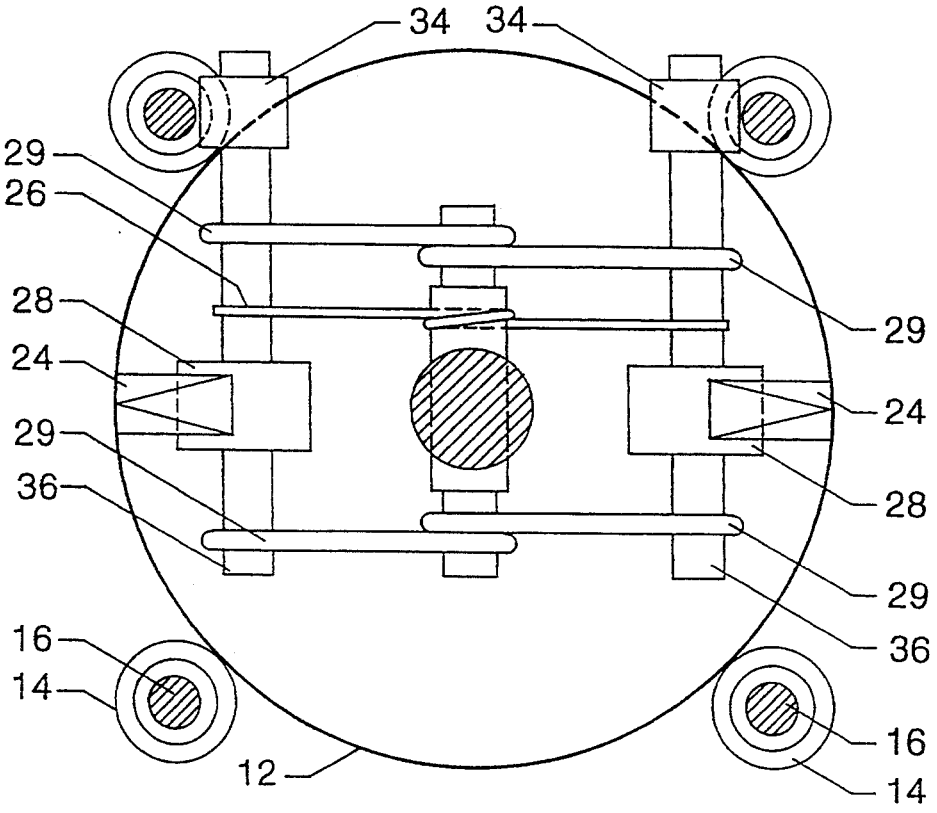
FIG. 5 is a detailed top plan view in transverse section of a portion of the release mechanism illustrated in FIG. 1.

Referring to FIG. 1, there is illustrated a hammer 12. Referring to FIG. 3, hammer 12 has four vertically aligned tubular members 14. Guide means are provided in the form of four rods 16 which extend through tubular members 14. Rods 16 guide hammer 12 from a raised release position along a substantially vertical downward impact path. Referring to FIGS. 1 and 2, a fluid expandable cylinder 18 is disposed above hammer 12. Fluid expandable cylinder 18 can be either hydraulic or pneumatic. Fluid expandable cylinder 18 has a telescopically extendible piston 20 which serves as means for lifting hammer 12 to the raised release position. The details of release mechanism 10 will now be described. Referring to FIGS. 1, 2, and 4, hammer 12 has a female top member 22 with inwardly directed gripping dogs 24. Piston 20 has a generally "V" shaped male member with two outwardly biased arms 29. Arms 29 have gripping rollers 28 at each extremity 30. Spring member 26 biases arms 29 outwardly. The outward biasing of arms 29 by spring 26 enables rollers 28 to engage and when triggered disengage, dogs 24 of female top member 22 on hammer 12. Inclined plane triggering mechanisms 32 are positioned on rods 16 at the raised release position. Referring to FIG. 5, triggering rollers 34 are mounted adjacent to and on a common axis with gripping rollers 28, the common axis being represented by pin 36. As hammer 12 is raised, triggering rollers 34 move along guide rods 16 until triggering rollers 34 engage inclined planes 32. Triggering rollers 34 move together as they climb inclined planes 32. Of course, as triggering rollers 34 move together, outwardly biased arms 29 and, consequently, gripping rollers 28 also move together. This overcomes the biasing force of spring member 26 sufficiently to release gripping rollers 28 from inwardly directed gripping dogs 24 of female top member 22 on hammer 12. Once gripping rollers 28 are released hammer 12 falls by force of gravity. Referring to FIG. 1, spring cylinders 38 are supported in a substantially vertically aligned position by rods 16. Spring cylinders 38 contain springs 40 with depending engagement members 42. Hammer 12 has cooperating external pockets 44. Pockets 44 receive engagement members 42 as hammer 12 is raised by piston 20 of fluid expandable cylinder 18 to the raised release position represented by inclined planes 32. As hammer 12 is raised springs 40 are compressed, as illustrated in FIG. 1. Springs 40 impart a violent downward acceleration to hammer 12 upon hammer 12 being released.

The use and operation of release mechanism 10 will now be described with reference to FIGS. 1 through 5. Hammer 12 and piston 20 start in a disengaged position, as illustrated in FIG. 2. When piston 20 is lowered "V" shaped outwardly biased arms 29 enter female top member 22 on hammer 12. The outward spring biasing arms 29 in gripping rollers 28 collapsing to enter female top member 22 and then expanding outwardly to engage inwardly directed gripping dogs 24, as illustrated in FIG. 1. Once engaged piston 20 serves to lift hammer 12 to the raised release position. The "V" shape of arms 29 results in arms 29 spreading to more closely engage inwardly directed gripping dogs 24 when under load conditions Referring to FIGS. 4 and 5, inclined planes 32 are positioned at the raised release position. Triggering rollers 34 climb inclined planes 32. This causes triggering rollers 34 and rollers 28 to move together overcoming the spring biasing force of "V" shaped male spring member 26 until gripping rollers 28 are released from inwardly directed gripping dogs 24 of female top member 22 on hammer 12. Once gripping rollers 28 are released hammer 12 falls by force of gravity. Referring to FIGS. 1 and 2, external pockets 44 on hammer 12 receive engagement members 42 from spring cylinders 38 as hammer 12 is raised by piston 20 of fluid expandable cylinder 18 to the raised release position represented by inclined planes 32. As hammer 12 is raised springs 40 are compressed, as illustrated in FIG. 1. As hammer 12 is raised, triggering rollers 34 move along guide rods 16 until triggering rollers 34 engage inclined planes 32. Triggering rollers 34 move together as they climb inclined planes 32. Of course, as triggering rollers 34 move together, outwardly biased arms 29 and, consequently, gripping rollers 28 also move together, as shown in FIG. 2. This overcomes the biasing force of spring member 26 sufficiently to release gripping rollers 28 from inwardly directed gripping dogs 24 of female top member 22 on hammer 12. Once gripping rollers 28 are released, hammer 12 is in a position to fall by force of gravity completely unfettered by the means used to lift hammer 12, as shown in FIG. 2. Springs 40 impart an additional violent downward acceleration to hammer 12.

It will be apparent to one skilled in the art that modifications may be made to the illustrated embodiment without departing from the spirit and scope of the invention as defined by the claims.

I claim:

1. A release mechanism for an hydraulic post driver having a hammer, guide means for directing the hammer from a raised release position along a substantially vertical downward impact path, and a fluid expandable cylinder disposed above the hammer and having a telescopically extendible piston serving as means for lifting the hammer to the raised position, the improvement comprising:

the hammer having a female member with inwardly directed gripping means;

the piston having a male member with outwardly directed arms forming a generally "V" shape, the arms having gripping rollers at each extremity;

the outwardly directed arms being biased by a spring;

triggering means on the guide means to overcome the biasing force of the spring to disengage the inwardly directed gripping means and the outwardly directed gripping means when the hammer reaches the raised release position, the triggering means including inclined planes on the guide means, and tripping rollers adjacent the gripping rollers at the extremities of the outwardly biased arms of the "V" shaped male member, the tripping rollers are vertically aligned with the guide means such that the tripping rollers move along the guide means until they engage the inclined planes, as the tripping rollers move up the inclined planes the biased arms of the "V" shaped male members move together thereby releasing the gripping rollers from the female member on the hammer to let the hammer fall by force of gravity.

2. The release mechanism as defined in claim 1, wherein the hammer has a female top member with inwardly directed gripping dogs.

3. The release mechanism as defined in claim 1, wherein the hammer has a plurality of vertically aligned tubular members and the guide means includes rods extendible through the tubular members.

4. The release mechanism as defined in claim 1, wherein cylinders are mounted to the guide means, the cylinders containing springs with depending engagement members, the hammer having external pockets that receive the engagement members as the hammer is raised by the fluid expandable cylinder to the raised release position such that as the hammer is raised the springs are compressed resulting in the spring imparting a violent downward acceleration to the hammer upon the hammer being released.

5. A release mechanism for an hydraulic post driver having a hammer, guide means for directing the hammer from a raised release position along a substantially vertical downward impact path, and a fluid expandable cylinder disposed above the hammer and having a telescopically extendible piston serving as means for lifting the hammer to the raised position, the improvement comprising:

a hammer having a female top member with inwardly directed gripping dogs;

a piston having a generally "V" shaped male member with arms outwardly biased by a spring, the outwardly biased arms having gripping rollers at each extremity and tripping rollers adjacent the gripping rollers, the tripping rollers being vertically aligned with and move along the guide means; and inclined planes on the guide means, such that the tripping rollers move along the guide means until they engage the inclined planes, as the tripping rollers move up the inclined planes the outwardly biased arms of the "V" shaped male members move together thereby releasing the gripping rollers from the inwardly directed gripping dogs of the female top member on the hammer to let the hammer fall by force of gravity.

6. A release mechanism for an hydraulic post driver having a hammer, guide means for directing the hammer from a raised release position along a substantially vertical downward impact path, and a fluid expandable cylinder disposed above the hammer and having a telescopically extendible piston serving as means for lifting the hammer to the raised position, the improvement comprising:

a hammer having a female top member with inwardly directed gripping dogs;

a piston having a generally "V" shaped male member with arms outwardly biased by a spring, the outwardly biased arms having gripping rollers at each extremity and tripping rollers adjacent the gripping rollers, the tripping rollers being vertically aligned with and move along the guide means;

inclined planes on the guide means, such that the tripping rollers move along the guide means until they engage the inclined planes, as the tripping rollers move up the inclined planes the outwardly biased arms of the "V" shaped male members move together thereby releasing the gripping rollers from the inwardly directed gripping dogs of the female top member on the hammer to let the hammer fall by force of gravity; and cylinders mounted to the guide means, the cylinders containing springs with depending engagement members, the hammer having external pockets that receive the engagement members as the hammer is raised by the fluid expandable cylinder to the raised release position such that as the hammer is raised the springs are compressed resulting in the spring imparting a violent downward acceleration to the hammer upon the hammer being released.

* * * * *